United States Patent [19]

Woodhead et al.

[11] Patent Number: 4,950,940

[45] Date of Patent: Aug. 21, 1990

[54] CATHODE RAY TUBE WITH MEANS FOR PREVENTING BACKSCATTER FROM ELECTRON MULTIPLIER

[75] Inventors: Alfred W. Woodhead, Caterham; Ronald W. A. Gill; Alan G. Knapp, both of Crawley; Daphne L. Lamport, Caterham; Derek Washington, Wallington, all of United Kingdom

[73] Assignee: U. S. Philips Corporation, New York, N.Y.

[21] Appl. No.: 936,967

[22] Filed: Dec. 1, 1986

Related U.S. Application Data

[63] Continuation of Ser. No. 626,962, Jul. 2, 1984, abandoned.

[30] Foreign Application Priority Data

Jul. 8, 1983 [GB] United Kingdom ..... 8318494

[51] Int. Cl.[5] ..... H01J 29/80; H01J 43/28

[52] U.S. Cl. ..... 313/103 CM; 313/422; 313/107

[58] Field of Search ..... 313/422, 103, 103 CM, 313/105, 105 CM, 106, 107

[56] References Cited

U.S. PATENT DOCUMENTS 4,422,005 12/1983 Washington et al. ..... 313/105 CM
4,544,860 10/1985 Guest et al. ..... 313/103 CM

FOREIGN PATENT DOCUMENTS 2080016 1/1982 United Kingdom .
2101396 1/1983 United Kingdom ..... 313/422
2108314 5/1983 United Kingdom .

*Primary Examiner*—Kenneth Weider
*Attorney, Agent, or Firm*—Robert J. Kraus

[57] ABSTRACT

In order to reduce contrast degradation in an electrostatically scanned flat cathode ray tube having a channel plate electron multiplier, due to back-scattered electrons entering channels remote from their origin, a coating of a material having a low back-scatter coefficient is applied over the input of the electron multiplier between the apertures therein. The surface texture of the material should be microscopically rough. The material can be applied to the first dynode or to an electrode electrically and physically connected to the first dynode. The acceptance angle of the channel plate electron multiplier may also be restricted.

11 Claims, 3 Drawing Sheets

Fig.8.
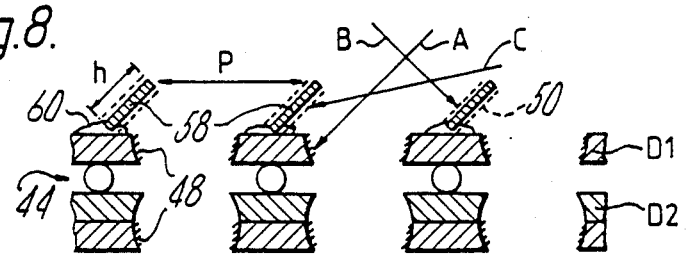
Fig.9A.
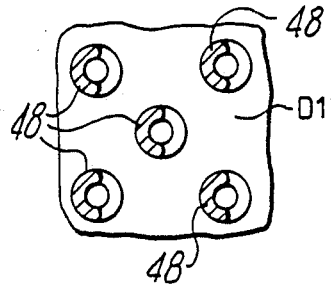
Fig.9B.
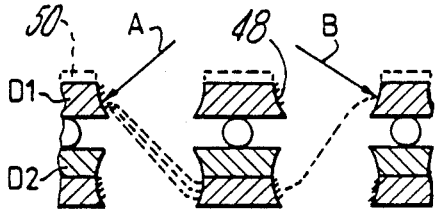
Fig.10 A.
Fig.10 B.
Fig.10 C.
Fig.10 D.
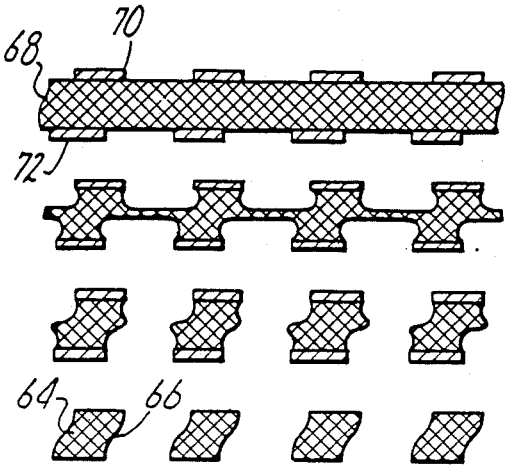

CATHODE RAY TUBE WITH MEANS FOR PREVENTING BACKSCATTER FROM ELECTRON MULTIPLIER

This is a continuation of application Ser. No. 626,962, filed July 2, 1984, abandoned.

BACKGROUND OF THE INVENTION

The present invention relates to a cathode ray tube, and particularly, but not exclusively, to a display tube having a channel plate electron multiplier and electrostatic beam scanning at the input side of the electron multiplier.

British Patent Specification No. 2101396A discloses such a display tube. Display tubes having channel plate electron multipliers are particularly susceptible to contrast degradation due to electrons being scattered from the input surface of the electron multiplier and entering channels at a point distant from their point of origin. In the case of electrostatically scanned display tubes, particularly flat display tubes, it is not possible to produce a positively biased field at the input side of the electron multiplier to draw-off back-scattered electrons because this would conflict with the field conditions necessary to achieve proper scanning of the incident electron beam, these field conditions being created by deflection electrodes held at the same potential or a more negative potential than the multiplier input.

SUMMARY OF THE INVENTION

It is an object of the present invention to reduce the contrast degradation due to back-scattered electrons in cathode ray tubes having a channel plate electron multiplier and especially those having electrostatic beam scanning.

According to the present invention there is provided a cathode ray tube comprising an envelope having an optically transparent faceplate, and within the envelope, means for producing an electron beam, a channel plate electron multiplier mounted adjacent to, but spaced from, the faceplate, scanning means for scanning the electron beam across an input side of the electron multiplier, and a layer having a low back-scatter coefficient covering the area of the input side of the electron multiplier between the channels.

From a practical point of view it is desirable that the layer also has a low secondary emission coefficient to reduce the number of stray secondary electrons which can cause a further reduction in contrast.

In the present invention by a low back-scatter coefficient is meant a coefficient which is less than that of a smooth carbon layer and by a low secondary emission coefficient is meant a value less than 2.0 for electrons in the energy range 300 to 500eV.

In an embodiment of the present invention the scanning means comprises a carrier member spaced from and arranged substantially parallel to the input side of the electron multiplier, the carrier member having thereon a plurality of adjacent, substantially parallel electrodes which in response to voltages applied thereto deflect the electron beam from a path between the carrier member and the input side of the electron multiplier, towards said input side. The electron multiplier itself may comprise a laminated stack of discrete dynodes.

It has been found desirable that either the surface onto which the layer is applied or the layer itself is microscopically rough. This reduces significantly the number of back-scattered electrons produced.

The layer of low back-scatter material may be applied to the input (or first) dynode of the electron multiplier or alternatively to an apertured electrode which is mounted on the input dynode.

The low back-scatter material may comprise black chromium, black nickel, black copper, optionally coated with a conductive layer, such as carbon, which has a low secondary emission and/or low back-scatter coefficient, or anodised aluminium onto which an electrically conductive coating is applied.

Back-scatter from the input of the electron multiplier can be reduced further by limiting the acceptance angle of the electron multiplier. This is possible particularly in a flat display tube in which an addressing electron beam impinges on the input dynode at fairly well defined angles whereas back-scattered electrons arrive at random angles.

The acceptance angle may be limited in a number of ways. If it is desired to physically restrict the acceptance angle then this can be done by mounting inclined vanes on the input dynode or mounting one or more apertured electrodes on the input dynode, the or each electrode being offset relative to the input dynode and/or each other so that the apertures in the electrode(s) form correspondingly inclined passages to their associated channels in the electron multiplier. The apertures in the or each electrode may be slanted.

Another way of limiting the acceptance angle is to reduce the number of secondary electrons produced by back-scattered electrons by applying secondary emitting material to corresponding restricted portions of the peripheries of the convergent apertures in the input dynode. In this way, the addressing electron beam strikes the secondary emitting material and produces many secondary electrons whereas back-scattered electrons which will approach the input dynode at other angles will strike the untreated areas of the hole peripheries and will produce significantly fewer secondary electrons.

BRIEF DESCRIPTION OF THE DRAWINGS

The present invention will now be described, by way of example, with reference to the accompanying drawing, wherein:

FIGS. 6 to 9 are diagrammatic cross-sectional views of part of an electron multiplier and illustrate different ways of limiting the acceptance angle of the electron multiplier, and FIGS. 10A to 10D illustrate the various stages in making an electrode with slanted apertures.

In the drawings corresponding reference numerals have been used to indicate the same parts.

DESCRIPTION OF THE PREFERRED EMBODIMENTS

Figure 1:
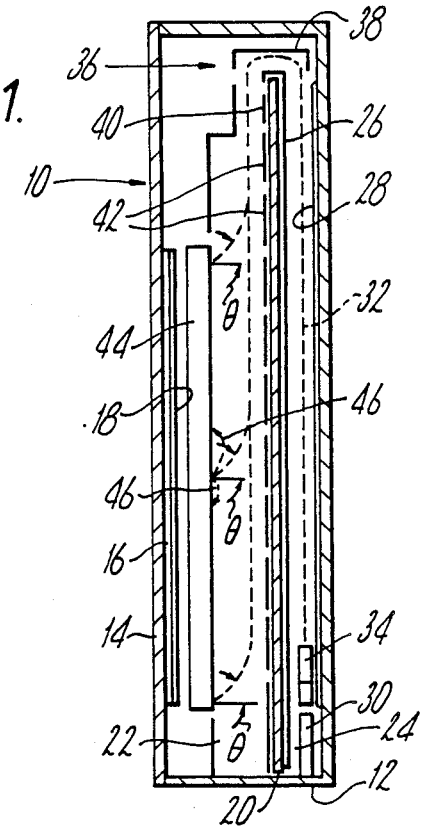
FIG. 1 is a cross section through a flat display tube which includes a channel plate electron multiplier.

The flat display tube 10 shown in FIG. 1 is of the type described and claimed in British Patent Specification No. 2101396A. A brief description of the display tube and its operation will now be given but for a fuller description reference should be made to Specification No. 2101396A, details of which are incorporated by way of reference.

The flat display tube 10 comprises an envelope 12 including an optically transparent, planar faceplate 14. On the inside of the faceplate 14 is a phosphor screen 16 with an electrically conductive backing electrode 18 thereon.

For convenience of description, the interior of the envelope 12 is divided in a plane parallel to the faceplate 14 by an internal partition or divider 20 to form a front portion 22 and a rear portion 24. The divider 20, which comprises an insulator such as glass, extends for substantially a major part of the height of the envelope 12. A planar electrode 26 is provided on a rear side of the divider 20. The electrode 26 extends over the exposed edge of the divider 20 and continues for a short distance down its front side. Another electrode 28 is provided on the inside surface of a rear wall of the envelope 12.

Means 30 for producing an upwardly directed electron beam 32 is provided in the rear portion 24 adjacent a lower edge of the envelope 12. The means 30 may be an electron gun. An upwardly directed electrostatic line deflector 34 is spaced by a short distance from the final anode of the electron beam producing means 30 and is arranged substantially coaxially thereof. If desired the line deflector 34 may be electromagnetic.

At the upper end of the interior of the envelope 12 there is provided a reversing lens 36 comprising an inverted trough-like electrode 38 which is spaced above and disposed symmetrically with respect to the upper edge of the divider 20. By maintaining a potential difference between the electrodes 26 and 38 the electron beam 32 is reversed in direction whilst continuing along the same angular path from the line deflector 34.

On the front side of the divider 20 there are provided a plurality of laterally elongate, vertically spaced electrodes of which the uppermost electrode 40 may be narrower and acts as a correction electrode. The other electrodes 42 are selectively energised to provide frame deflection of the electron beam 32 onto the input surface of a laminated dynode electron multiplier 44. The laminated dynode electron multiplier 44 and its operation will be described in greater detail later with reference to FIG. 2. The electrons leaving the final dynode are accelerated towards the screen 16 by an accelerating field being maintained between the output of the electron multiplier 44 and the electrode 18.

In the operation of the display tube the following typical voltages are applied reference being made to 0V, the cathode potential of the electron gun 30. The electrodes 26, 28 in the rear portion 24 of the envelope 12 are at 400V to define a field free space in which line deflection takes place with potential changes of about ±30V applied to the line deflectors 34. The trough-like electrode 38 of the reversing lens is at 0V compared to the 400V of the extension of the electrode 26 over the top edge of the divider 20. The input surface of the electron multiplier 44 is at 400V whilst at the beginning of each frame scan the electrodes 42 are at 0V but are sequentially brought up to 400V so that the electron beam 32 in the front portion 22 is initially deflected into the topmost apertures of the electron multiplier 44. As subsequent ones of the electrodes 42 are brought up to 400V to form a field free space with the electron multiplier 44, the electron beam 32 is deflected towards the electron multiplier 44 in the vicinity of the next electrode 42 in the group to be at 0V. It is to be noted that the landing angles $\theta$ of the electron beam 32 are fairly constant over the input side of the electron multiplier, these angles being typically between 30° and 40° in the illustrated embodiment. Assuming a potential difference of 3.0 kV across the electron multiplier 44 and allowing for the 400V at the input side of the multiplier, then the potential at the output side is equal to 3.4 kV. The electrode 18 is typically at a potential of 11 kV to form an accelerating field between the output side of the electron multiplier 44 and the screen 16.

Because the frame deflection electrodes 42 are at the same voltage or less with reference to the input surface of the electron multiplier 44 then any back-scattered electrons 46 produced by scattering of the input electrons, particularly in bright areas of an image being reproduced, are caused to enter channels of the electron multiplier 44 at other points which leads to a degradation of contrast. Back-scattered electrons are those electrons having energies greater than 50 eV.

Two approaches to overcome this degradation of contrast will be described with reference to FIGS. 2 to 10. In summary these approaches are to reduce back-scattered electrons by (1) covering the input surface, apart from the channel openings with a material having a low back-scatter coefficient, and (2) limiting the acceptance angle of the electron multiplier. Approaches (1) and (2) can be used either independently or together.

Figure 2:
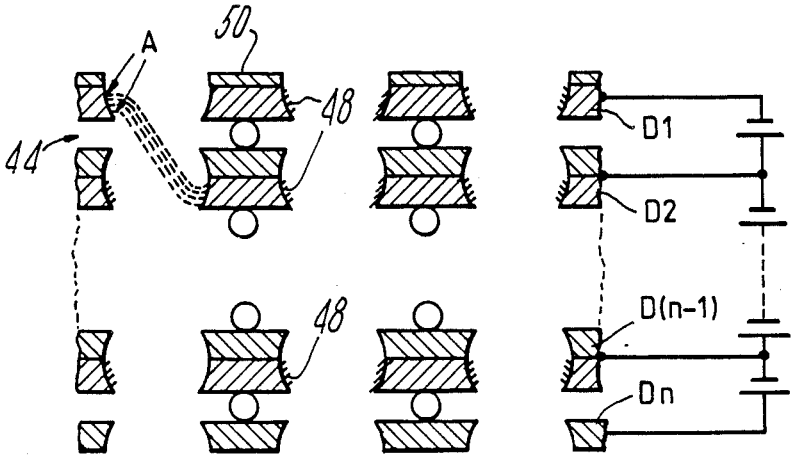
FIG. 2 is a diagrammatic cross-sectional view through a laminated plate electron multiplier having a material with a low back-scatter coefficient applied to the input dynode.

Referring to FIG. 2, the laminated dynode electron multiplier 44 and its operation is described in a number of published patent specifications of which British Patent Specifications Nos. 1401969, 1434053 and 2023332B are but a few examples. Accordingly only a brief description of the electron multiplier 44 will be given.

The electron multiplier 44 comprises a stack of n spaced apart, apertured dynodes, referenced D1 to Dn, held at progressively higher voltages, the potential difference between adjacent dynodes being in a typical range of 200 to 500V. The apertures in the dynodes are aligned to form channels. The dynodes are made from etched mild steel plates. Dynodes D2 to D(n−1) have re-entrant apertures and these are formed by etching convergent apertures in the mild steel plates and assembling them in pairs with the smaller cross-sectional openings facing outwards. The first and last dynodes D1 and Dn, respectively comprise single mild steel sheets. As mild steel is not a good secondary emitter, a secondary emitting material 48, such as magnesium oxide, is deposited in the apertures of the first dynode D1 and the lower half of each dynode D2 to D(n−1) as shown in FIG. 2. Primary electrons A striking the wall of an aperture in the first dynode D1 produce a number of secondary electrons, each of which on impacting with the wall of an aligned aperture in the second dynode D2 produce more secondary electrons (not shown), and so on. The stream of electrons leaving the final dynode Dn, which acts as a focusing electrode, are accelerated to the screen (not shown in FIG. 2).

Primary electrons striking the area of the first dynode D1 between the apertures may give rise to back-scattered electrons which enter apertures remote from their point of origin causing the contrast of the image viewed on the screen (not shown) to be degraded. In order to reduce the occurrence of back-scattered electrons, particularly high energy ones, a layer 50 of a material having a low back-scatter coefficient is applied to the first dynode D1 in the area between the apertures in the first dynode D1.

Figure 3A:
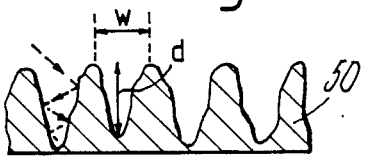
FIGS. 3A and 3B are diagrammatic cross-sectional views of two alternative rough surfaces.
Figure 3B:
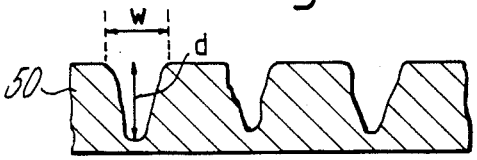

In order to be effective it has been found that the surface onto which the layer 50 is applied and/or the material itself should be microscopically rough as shown in FIGS. 3A and 3B. The roughness should be such that the distance w between adjacent peaks should be less than the distance, d, from the peaks to the intervening trough. Electrons entering the cavities undergo several reflections, each time losing energy. Thus even if they escape from the cavity they will not travel far thus not seriously degrading the contrast of a reproduced image.

Various materials have been found to be suitable for the layer 50, some of these materials produce their roughness by having a nodular surface, FIG. 3A, and others of these materials produce their roughness by forming pits in an otherwise flat surface, FIG. 3B.

Materials producing a nodular surface which has been found to reduce back-scattering are black chromium plated on electroless nickel-coated steel, black copper plated on electroless nickel-coated steel and carbon coated black copper plated on electroless nickel-coated steel. Two materials producing a pitted type of surface are acid treated, electroless nickel and anodised, aluminium plated steel which has been carbon coated to provide a conductive surface to prevent charging. Taking both performance and ease of processing points of view into consideration the best of the above materials is carbon coated black copper. Another factor in providing a carbon coating is that it reduces the secondary emission as well as the back-scattering from the roughened surfaces.

Instead of applying the material 50 to the first dynode D1, the material 50 can be applied to a carrier electrode 52 which is electrically and physically connected, for example by spot welding, to the first dynode D1.

Figure 4:
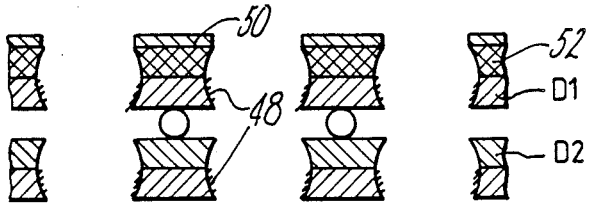
FIGS. 4 and 5 are diagrammatic cross-sectional views through the first two dynodes of an electron multiplier showing two different ways of mounting layers of material with a low back-scatter coefficient.

In FIG. 4 the carrier electrode 52 conveniently comprises a half dynode to which the material 50 is applied prior to it being connected to the first dynode D1. As shown re-entrant apertures are formed by the combination of the carrier electrode 52 and the first dynode D1.

Figure 5:
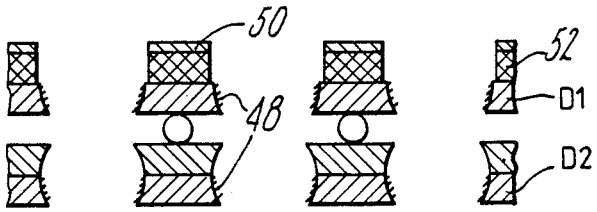

The arrangement shown in FIG. 5 differs from that shown in FIG. 4 in that the apertures in the carrier electrode 52 are substantially straight-sided rather than divergent and the cross-sectional size of these apertures corresponds to the openings in the adjoining surface of the first dynode D1. Conveniently the straight-sided apertures can be made by over-etching the apertures in a half dynode to be used as the carrier electrode.

FIGS. 6 to 9 show various embodiments in which the approach angle of electrons in the addressing beam is limited. In FIG. 1 the angle $\theta$ is substantially constant and is in the range 30° to 40°. Thus by limiting the approach angle $(90°-\theta)$ to between 50° and 60° then electrons having different approach angles will not enter the electron multiplier 44 and in so doing this will eliminate the majority of the back-scattered electrons. Optionally the outermost surfaces in FIGS. 6 to 9 may be covered by a layer 50 of material having a low back-scatter coefficient, this is indicated in broken lines.

Figure 6:
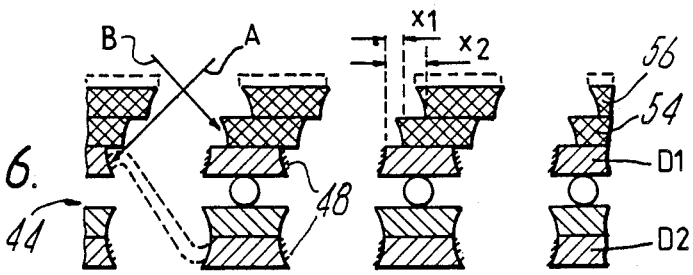

Referring more particularly to FIG. 6, the means for limiting the approach angle comprises two apertured electrodes 54, 56 electrically and physically connected to the first dynode D1. The size and pitch of the apertures in the electrodes 54, 56 correspond to that of the first dynode but the electrode 54 is offset by a predetermined amount $x_1$ relative to the first dynode D1 and the electrode 56 is offset in the same direction relative to the electrode 54 and the dynode D1 by an overall amount $x_2$ so that together they define inclined paths or channels to the first dynode D1. By way of example for an electron multiplier 44 in which the thickness of each of the electrodes 54, 56 and the first dynode D1 is 0.15 mm, the pitch of the apertures is 0.772 mm, $x_1=0.17$ mm and $x_2=0.225$ mm. If desired the apertures in the electrodes may be elongate in a direction normal to the plane of the drawing. In operation the primary electrons denoted by the arrow A strike the secondary emitting material 48 of the first dynode D1 and produce secondary electrons which are drawn through to the second dynode D2. However, electrons such as those denoted by the arrow B strike the electrode 54 and produce a small number of secondaries because of the low secondary emission coefficient of mild steel. Although this small number of secondaries may undergo electron multiplication their contribution to the brightness of the image is small.

Figure 7:
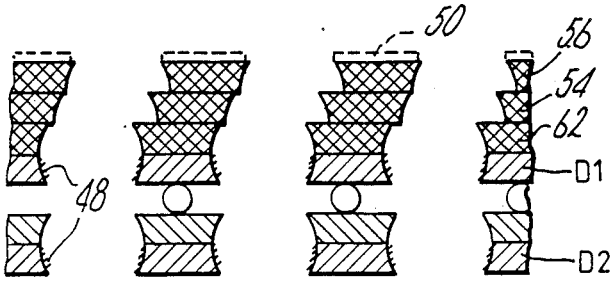

The embodiment shown in FIG. 7 is a variant of that shown in FIG. 6 in that an additional electrode 62 is disposed with zero offset between the first dynode D1 and the electrode 54. Because the apertures in the electrode 62 are downwardly divergent, as shown in FIG. 7, then together with the apertures in the first dynode D1 they form re-entrant apertures.

In the embodiment shown in FIG. 8 the inclined paths to the first dynode D1 are formed by metal vanes 58 forming a Venetian blind type of structure over the multiplier input. If the height h of each vane 58 is greater than the distance, p, between them then the vanes may either be formed individually and bonded on to the input dynode D1 by for example glass enamel 60, or be preformed from single sheets of metal, several of which are mounted, each offset from the other by an appropriate integral multiple of the distance p. Alternatively if the height, h, is less than, or equal to, the distance p then the vanes 58 can be pressed out of a single sheet of metal. In operation electrons having trajectories indicated by the arrow A will undergo electron multiplication but those having other trajectories, for example as denoted by the arrows B and C, strike the vanes 58 and any back-scattered electrons follow trajectories where they are unlikely to enter channels of the electron multiplier 44.

FIGS. 9A and 9B illustrate another approach to limiting the acceptance angle of the current multiplier. In this embodiment, secondary emitting material 48 is applied to a restricted area of each aperture in the first dynode D1. In use electrons arriving in the direction denoted by the arrow A strike the secondary emitting material 48 and produce a large number of secondary electrons which are drawn through to the second dynode D2. However stray or back-scattered electrons arriving in the direction B strike the portion of the periphery of an aperture which has a low secondary emission coefficient thus producing very few secondary electrons compared to the situation if the secondary emitting material was there.

FIGS. 10A to 10D show the steps in making an electrode 64 having slanted apertures 66. The material of the electrode 64 comprises a sheet 68 of mild steel having a thickness at least equal to that of a half dynode. Offset photoresist patterns 70, 72 are applied to opposite sides of the sheet 68. Double sided etching is commenced as shown in FIG. 10B. In due course the holes formed in each side break through see FIG. 10C. Etching is continued until the slanting holes 66 are formed, thereafter etching is stopped and the photoresist patterns 70, 72 are removed to leave the electrode 64 as shown in FIG. 10D.

In use the electrode 64 is electrically and physically connected to the first dynode D1 and optionally a layer 50 of material having a low back-scatter coefficient is applied.

We claim:

1. A cathode ray tube comprising an envelope having an optically transparent faceplate and, within the envelope, means for producing an electron beam, a channel plate electron multiplier including an input side having a multiplicity of openings defining entrances to respective channels having walls including secondary emissive material, said multiplier being mounted adjacent to, but spaced from, the faceplate, scanning means for scanning the electron beam across the input side of the electron multiplier, and a layer having a low back-scatter coefficient covering the area of the input side of the electron multiplier between the openings, said back-scatter coefficient being lower than that of a smooth carbon layer.

2. A cathode ray tube comprising an envelope having an optically-transparent faceplate, said envelope containing:

(a) means for producing an electron beam directed toward said faceplate;

(b) a channel plate electron multiplier spaced from the faceplate and including an input side having a multiplicity of openings defining entrances to respective electron-multiplying channels having walls including secondary emissive material, said multiplier including a microscopically-rough layer of a material having a low back-scatter coefficient covering the area of the input side lying between the openings, said back-scatter coefficient being smaller than that of a smooth carbon layer; and (c) means for scanning the electron beam across the input side of the multiplier.

3. A cathode ray tube comprising an envelope having an optically-transparent faceplate, said envelope containing:

(a) means for producing an electron beam directed toward said faceplate;

(b) a channel plate electron multiplier spaced from the faceplate and including an input side having a multiplicity of openings defining entrances to respective electron-multiplying channels, inner walls of the entrances and of the channels including secondary emissive material, said multiplier including a layer of a material having a low back-scatter coefficient covering the area of the input side lying between the openings, said back-scatter coefficient being smaller than that of a smooth carbon layer;

(c) means for scanning the electron beam across the input side of the multiplier.

4. A cathode ray tube as in claim 1, 2 or 3 where said layer has a secondary emission coefficient which is smaller than 2.0 for incident electrons having an energy lying in the range between 300 and 500 electron volts.

5. A cathode ray tube as in claim 1, 2 or 3 where said scanning means comprises a carrier member spaced from and arranged substantially parallel to said input side, the carrier member having thereon a plurality of adjacent, substantially parallel electrodes which, in response to voltages applied thereto, deflect the electron beam from a path between the carrier member and the electron multiplier toward said input side.

6. A cathode ray tube as in claim 1, 2 or 3 where said electron multiplier comprises a laminated stack of discrete dynodes.

7. A cathode ray tube as in claim 1, 2 or 3 where said layer consists essentially of black chromium.

8. A cathode ray tube as in claim 1, 2 or 3 where said layer consists essentially of black nickel.

9. A cathode ray tube as in claim 1, 2 or 3 where said layer consists essentially of black copper.

10. A cathode ray tube as in claim 1, 2 or 3 where an electrically conductive coating is applied to said layer.

11. A cathode ray tube as in claim 1, 2 or 3 where said layer consists essentially of anodized aluminum onto which an electrically conductive coating is applied.

* * * * *